United States Patent [19]

York

[11] Patent Number: 4,632,090

[45] Date of Patent: Dec. 30, 1986

[54] STOVE ARRANGEMENT

[76] Inventor: Marty York, P.O. Box F, Marrowbone, Ky. 42759

[21] Appl. No.: 670,874

[22] Filed: Nov. 13, 1984

[51] Int. Cl.[4] ..... F24H 3/02

[52] U.S. Cl. ..... 126/110 R; 126/110 E; 126/99 R; 126/104 A; 126/112

[58] Field of Search ..... 126/110 R, 110 E, 99 A, 126/104 R, 104 A, 112, 15 A

[56] References Cited

U.S. PATENT DOCUMENTS

| | | | |
|---|---|---|---|
| 1,308,194 | 7/1919 | Rohan | 126/117 |
| 4,122,999 | 10/1978 | Belcastro | 126/110 R |
| 4,138,062 | 2/1979 | Graden | 126/117 |
| 4,232,653 | 11/1980 | Otterpohl | 126/112 |
| 4,265,214 | 5/1981 | Rasmussen | 126/15 A |
| 4,485,800 | 12/1984 | Stevenson | 126/112 |

*Primary Examiner*—Carroll B. Dority, Jr.
*Attorney, Agent, or Firm*—Edward M. Steutermann

[57] ABSTRACT

An improved solid fuel burning stove arrangement to heat a selected space including a housing defining a combustion chamber, with an access door thereto for providing fuel to the chamber, a tubular combustion air sparger located longitudinally in the bottom of the chamber and having a multiplicity of generally radially directed air flow apertures, an air supply for the sparger to supply combustion air to the combustion chamber, a plenum chamber disposed in heat contact relation with the housing to receive heat generated in the combustion chamber, an air inlet to the plenum chamber and air outlet from the plenum chamber to the space to be heated, an exhaust stack communicating with the combustion chamber, a stack plenum chamber surrounding a portion of the exhaust stack to receive heat from the combustion gases passing therethrough and having an air inlet and a heated air outlet from the exhaust stack plenum chamber and further including first control device to initiate operation of the combustion air supply when the temperature in a space to be heated is at a selected temperature which includes second control device to control supply of air to the plenum chamber in response to temperature of the air in the combustion chamber when a selected temperature in the plenum chamber is above a selected value.

3 Claims, 6 Drawing Figures

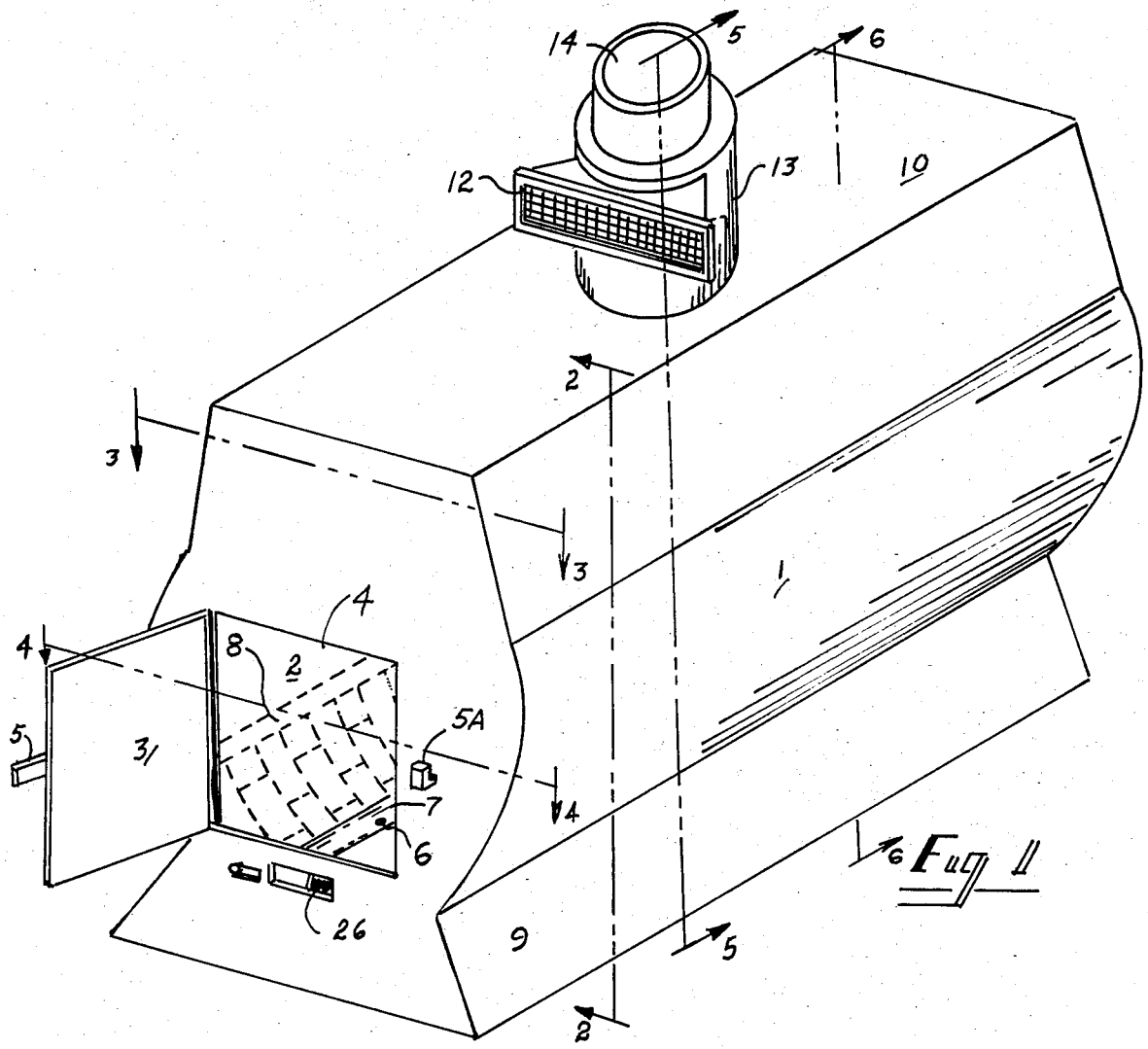
Fig 1
Fig 2
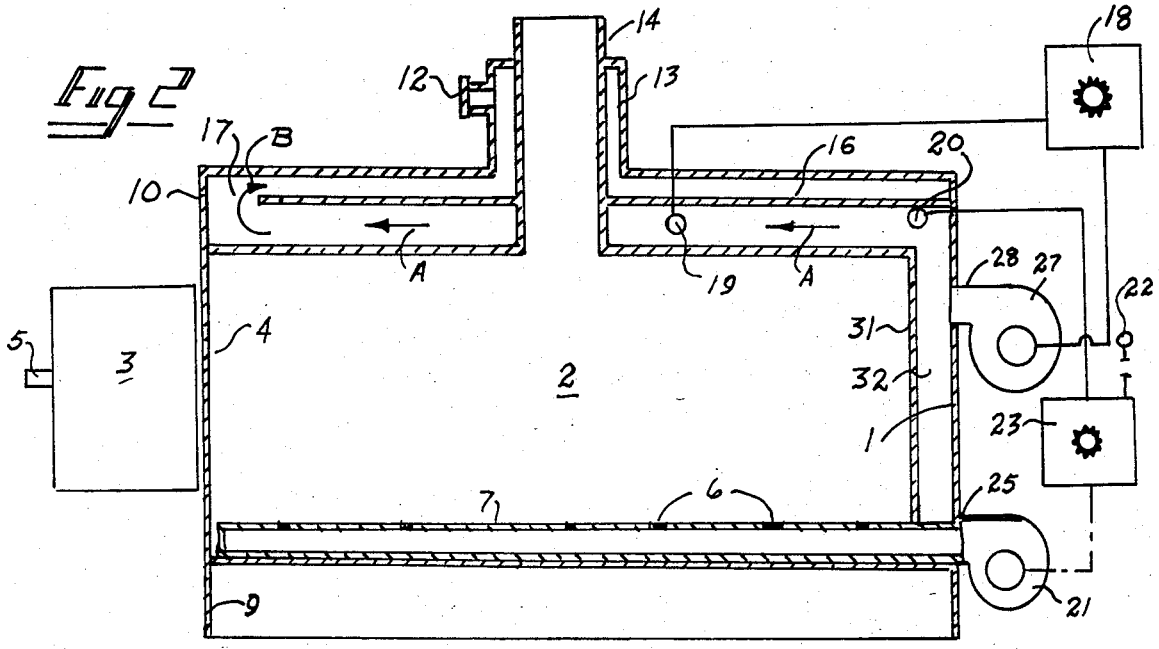

STOVE ARRANGEMENT

BACKGROUND OF THE INVENTION

The present invention relates generally to heating stoves and more particularly to a new and useful heating stove arrangement for economizing on fuel consumption and for selectively improving the efficiency of the heat recovery from the fuel.

Typical prior art arrangements are shown in U.S. Pat. Nos. 4,319,556—Schwartz; 4,373,506—Hyatt; 2,530,095—Stevens; 4,206,743—Neimela; and Swedish Patent No. 224,386—Clement, but none of these teaches the control arrangement provided by the present invention.

Heating stoves are well known in the art and numerous prior art devices are known to provide various plenum chambers and air supply means to the combustion chamber for combustion of the fuel.

Further, prior art arrangements are known wherein the various types of fuel, such as coal and wood can be utilized in the device and where blowers are provided to circulate air through various plenum chamber arrangement to improve the efficiency of heat recovery provided by the devices.

Additionally, prior art heating stoves utilizing solid fuels are known wherein control means are provided to operate the air supply means to the space to be heated when the temperature in the plenum chamber surrounding a portion of a combustion chamber is at a selected minimum.

However, no prior art devices are known which selectively improve the efficiency of the combustion of the solid fuel and control the rate of combustion thereof by means of regulation of combustion air supply in conjunction with the provision of safety overides and control devices to ensure efficient use of fuel as provided by the present invention.

SUMMARY OF THE INVENTION

The present invention provides a new and useful heating stove arrangement wherein the efficiency of the solid fuel is greatly improved. It has been unexpectedly found that by regulating the combustion air to the combustion chamber the fuel consumption efficiency as well as the efficiency of the recovery of heat from the unit can be dramatically improved.

Moreover, it has been unexpectedly found that devices within the scope of the present invention further provide means to effectively control temperatures in a space to be heated by control of combustion air supply.

Additionally, a new and novel plenum arrangements and baffle arrangements are provided by the present invention as well as a means for controlling the flow of air therethrough the plenum chamber to an area to a space to be heated.

More particularly an improved solid fuel burning stove arrangement to heat a selected space including a housing defining a combustion chamber, with an access door thereto for providing fuel to the chamber, a tubular combustion air sparger located longitudinally in the bottom of the chamber and having a multiplicity of generally radially directed air flow apertures, an air supply for the sparger to supply combustion air to the combustion chamber, a plenum chamber disposed in heat contact relation with the housing to receive heat generated in the combustion chamber, an air inlet to the plenum chamber and air outlet from the plenum chamber to the space to be heated, an exhaust stack communicating with the combustion chamber, a stack plenum chamber surrounding a portion of the exhaust stack to receive heat from the combustion gases passing therethrough and having an air inlet and a heated air outlet from the exhaust stack plenum chamber and further including first control device to initiate operation of the combustion air supply when the temperature in a space to be heated is at a selected temperature which includes second control device to control supply of air to the plenum chamber in response to temperature of the air in the combustion chamber when a selected temperature in the plenum chamber is above a selected value.

While it will be understood that various other arrangements are provided within the scope of the present invention the accompanying examples are shown in the drawings and illustrate one example within the scope of the present invention.

BRIEF DESCRIPTION OF THE DRAWINGS

FIG. 1 is a perspective view of one arrangement within the scope of the present invention;

FIG. 2 is a view taken along a plane passing along a line 2—2 of FIG. 1;

DETAILED DESCRIPTION OF THE DRAWINGS

Figure 3:
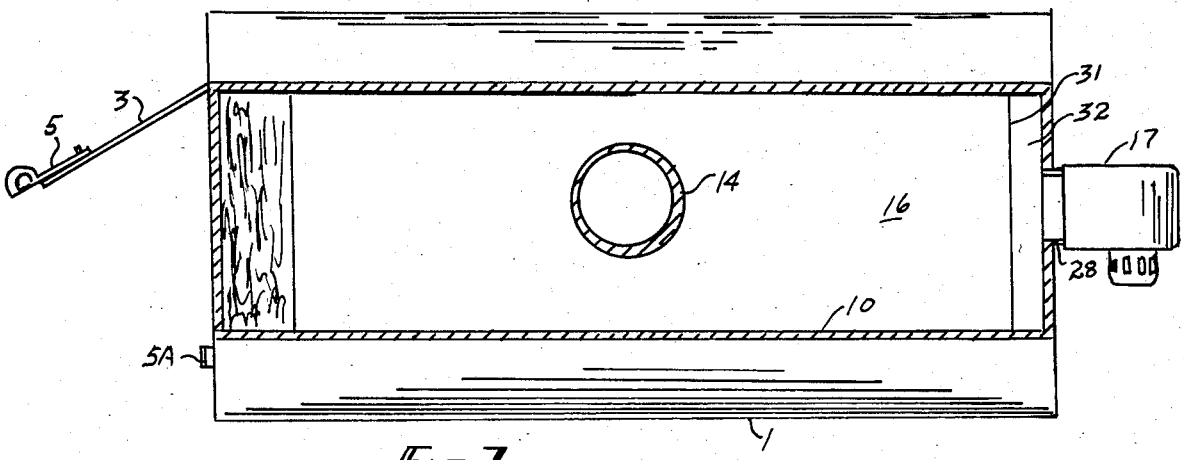
FIG. 3 is a view taken along a plane passing along a line 3—3 of FIG. 1.

In the arrangements shown in drawings a generally cylindrical enclosure 1 is provided to define a combustion chamber 2.

A door 3 is provided with a latch assembly 5 with keeper 5A on housing 1 to close an opening 4 which is utilized, for example, for the introduction of fuels, such as wood or coal, to the stove and for removal of ashes therefrom.

In accordance with one feature of the present invention an air sparger 7 is provided along the lower surface of enclosure 1 and includes generally radially directed air holes 6 to inject air into the combustion process as described hereinafter. It has been found that the arrangement of the type shown in FIG. 1 provides particularly complete combustion of the fuel whether it be coal or wood or other solid materials. Further, firebricks 8 illustrated by dotted lines can be provided within the chamber to prevent escape of heat through the bottom of the arrangement or to provide extended life to enclosure 1. Further, space between the fire bricks 8 have been found to provide conduits for the air emitted from the sparger 6 to further facilitate even combustion of the fuel.

A base 9 is provided to support enclosure 1 as shown and it will be recognized that other support ar A plenum 10 is provided atop enclosure 1 and is provided to receive air to be emitted through an outlet 12 provided in a stack plenum 13 surrounding a combustion products exhaust 14. Combustion products exhaust 14 communicates with chamber 2 as shown while plenum 13 communicates with plenum 10.

Referring to FIG. 2 which is a view taken along a plane passing through line 2—2 of FIG. 1 enclosure 1 is shown defining combustion chamber 2. In FIG. 2 it will be seen that a baffle 16 is provided within plenum 12 so that air flow provided through an inlet 17 is directed first over the top of enclosure 1 as shown by arrows A then turns around the end of baffle 16 in space 17 as shown by arrows B to pass upwardly through plenum chamber 13 defined around exhaust stack 14 so the air is emitted through outlet 12. It will be understood that other baffling arrangements may be utilized but in the arrangement shown the baffle is provided generally longitudinally to provide the maximum exposure of the air to the top of enclosure 1 and then to provide air to the exhaust gases for further heating. Blower 17 is provided to supply air against wall 31 thence to plenum 10 and is controlled by means of a controller 18 operated by sensor 19 located in plenum 10.

A second blower 21 is provided at an inlet 25 of sparger 7 to supply combustion air to the fuel located within combustion chamber 2.

Within the scope of the present invention a control arrangement for blower 21 is provided and more particularly, includes a temperature sensor 22 located in the space to be heated. A controller 23 is provided to receive the temperature determined by sensor 22 to operate blower 21 when the temperature in the space to be heated has declined to a selected value. For example the sensor 22 can be located in a far corner of a room in which the stove is located or even in another room if appropriate. The combustion air is supplied to the combustion chamber 2 only when the temperature in the space to be heated is at the preselected value so that during the period in which no heat is required, no combustion air is supplied to the combustion chamber and fuel is conserved. A damper 26 can be provided in the front of the stove to continuously supply minimal quantities of combustion air sufficient to maintain ignition of the fuel.

In accordance with another feature of the present invention a second temperature measuring element 20 is provided in plenum 10 which can be located to sense the temperature of the plenum wall, as shown, or can be located to determine the temperature of the air stream at a selected location in the plenum. Sensor 20 also supplies a signal to controller 23 so that when the temperature sensed by sensor 20 exceeds a selected value where it is desired to lower the sensed temperature controller 23 terminates operation of blower 21 to prevent overheating of the plenum or exhaust by excessively hot air from outlet 12. Blower 17, however, continues to operate to remove heat from the unit and lower temperature sensed by sensor 20. When the temperature sensed by sensor 20 falls below sensor 22 is still below the selected set point, then blower 21 will again supply combustion air to the fire chamber.

FIG. 3 is a view taken along a plane passing through line 3—3 of FIG. 1 illustrating the orientation of baffle 16 forming the air flow passageway and the space 17.

Figure 4:
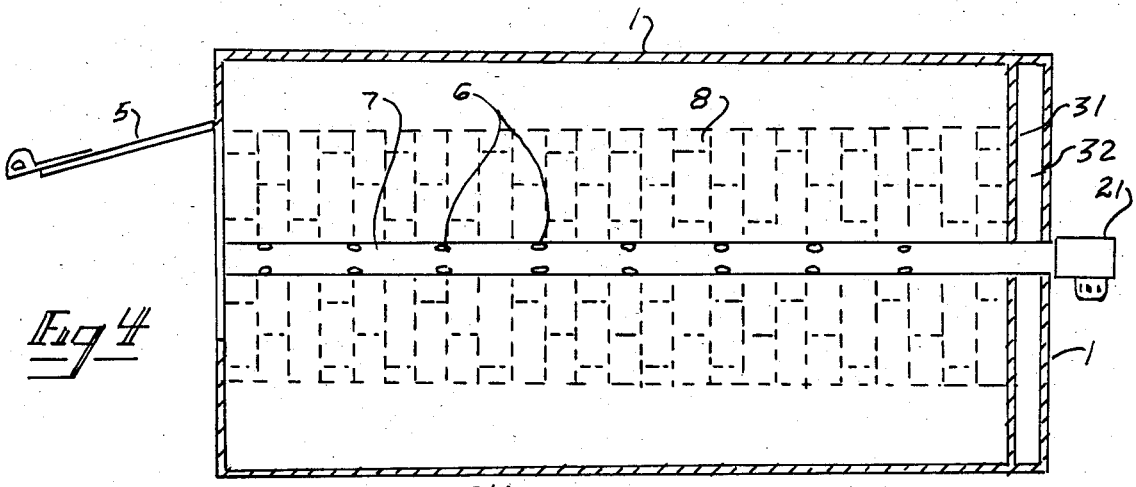
FIG. 4 is a view taken along a plane passing through line 4—4 of FIG. 1.

FIG. 4 is a view taken along a plane passing through line 4—4 of FIG. 1 illustrating a cross section of the combustion chamber and more particularly the location and orientation of the air sparger 6. Fire bricks 8 which may be provided in the bottom of enclosure 1 to provide protection from the bottom of enclosure 1 are illustrated.

Figure 5:
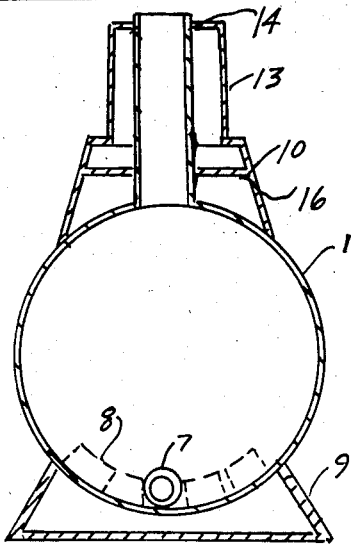
FIG. 5 is a view taken along a plane passing through line 5—5 of FIG. 1.

FIG. 5 is a view taken along a plane passing through a line 5—5 of FIG. 1 illustrating the orientation and position of the baffle 16 within the plenum chamber 10 as well as the position of sparger 6 within combustion chamber 1 and the location and orientation of firebricks 8.

Figure 6:
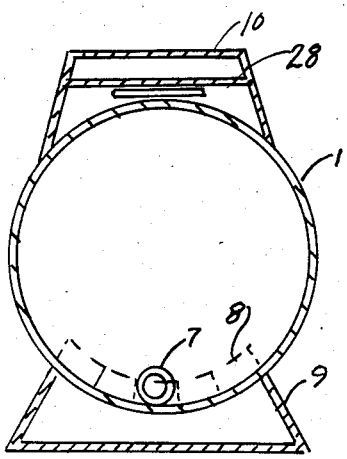
FIG. 6 is a view taken along a plane passing through line 6—6 of FIG. 1.

FIG. 6 is a view taken along a plane passing through line 6—6 of FIG. 1 illustrating the position of inlet 28 for the air to be heated.

The invention claimed is:

1. An improved solid fuel burning stove arrangement to heat a selected space including a housing defining a combustion chamber, an access door to said combustion chamber for providing fuel to the chamber, a tubular combustion air sparger located logitudinally in the bottom of the chamber and having a multiplicity of generally radially directed air flow apertures to direct air into solid fuel in the bottom of the chamber, first air supply means to supply air to said sparger to supply combustion air to said combustion chamber, means forming a plenum chamber in said housing to receive heat generated in said combustion chamber, first air inlet to said plenum chamber to receive air to be heated and a heated air outlet from said plenum chamber, an exhaust flue communication with said combustion chamber, second air supply means to supply air to said first air inlet; first control device to initiate operation of said first air supply means when the temperature in said space to be heated is below a selected temperature, second control means to initiate operation of said second air supply means when the temperature in said plenum means reaches a first selected plenum temperature and third control means to terminate operation of said first air supply means when the temperature at a selected location in said plenum chamber exceeds a second selected plenum temperature.

2. The invention of claim 1 including baffle means located within said plenum chamber to direct air entering said plenum chamber into heat conductive relation with said combustion chamber.

3. The invention of claim 1 including heat and flame resistant material located on the surface of said combustion chamber adjacent said sparger means.

* * * * *